United States Patent [19]

Kolton et al.

[11] Patent Number: 5,038,978

[45] Date of Patent: Aug. 13, 1991

[54] HANGER AND DISPLAY SUPPORT COMBINED THEREWITH

[75] Inventors: Chester Kolton, Westfield; Stuart S. Spater, Livingston, both of N.J.

[73] Assignee: B&G Plastics, Inc., New York, N.Y.

[21] Appl. No.: 434,286

[22] Filed: Nov. 13, 1989

[51] Int. Cl.[5] ..... A47G 25/14; A47G 25/44; A47D 1/00

[52] U.S. Cl. ..... 223/85; 223/88; 223/92; 223/95; 211/162; 211/94; 248/231.2; 403/76; 403/90

[58] Field of Search ..... 211/113, 162, 94; 248/220.2, 231.2; 223/85, 87, 88, 92, 95; 403/354, 70, 71, 90, 76, 122

[56] References Cited

U.S. PATENT DOCUMENTS

| | | | |
|---|---|---|---|
| 1,348,952 | 8/1920 | Landry | 40/322 |
| 1,389,266 | 8/1921 | Newton | 40/322 |
| 3,001,675 | 10/1961 | Aynes | 223/87 |
| 3,027,015 | 3/1962 | Miller | 211/94 |
| 4,006,547 | 2/1977 | Samuels et al. | 40/322 |

FOREIGN PATENT DOCUMENTS

| | | | |
|---|---|---|---|
| 487675 | 3/1953 | Italy | 211/94 |
| 728325 | 12/1966 | Italy | 403/90 |
| 170348 | 2/1960 | Sweden | 211/162 |

*Primary Examiner*—Werner H. Schroeder
*Assistant Examiner*—Bibhu Mohanty
*Attorney, Agent, or Firm*—Robin, Blecker, Daley & Driscoll

[57] ABSTRACT

A garment hanger is comprised of an integral body of resilient material having a first portion adapted for releasable receipt of a garment and a second portion for suspending the hanger from a display support. The second portion includes a stem projecting from the first portion and a centrally slotted generally spherical member is supported by said stem and is closable on such slot to exhibit a transient reduced diametric condition for joinder with the display support. The display support has a hollow interior and an opening extending longitudinally with the support and communicating with the interior. In its reduced diammetric condition, the spherical member has a diameter equal to or less than the width of the display support opening for insertion into the display support interior.

20 Claims, 3 Drawing Sheets

HANGER AND DISPLAY SUPPORT COMBINED THEREWITH

FIELD OF THE INVENTION

This invention relates generally to garment hangers and pertains more particularly to a hookless hanger for use with a display support and to the hanger and display support rod combination.

BACKGROUND OF THE INVENTION

From applicants' viewpoint, the customary garment hanger hook portion is disadvantageous in various respects. Since the hook portion extends outwardly of the hanger body proper, the hook portion consumes retail display space and thus gives rise to a lesser density of displayed garments than would obtain in the absence of the hook portion. A second consideration is the manipulative inconvenience involved in applying and removing the hanger from a display rod, typically requiring compound directional movements. Also, hanger costs are increased by the material costs of the hook portion.

SUMMARY OF THE INVENTION

The present invention has as its primary object the provision of hangers overcoming the above disadvantages.

A more particular object of the invention is to provide improved hookless hangers.

A further object of the invention is to provide enhanced compatibility as between display supports and hangers and an improved combination thereof.

In attaining the foregoing and other objects, the invention provides a garment hanger comprised of an integral body of resilient material having a first portion adapted for releasable receipt of a garment and a second portion for suspending the hanger from a display support, the second portion including a stem projecting from the first portion and a centrally slotted generally spherical member supported by the stem and closable on such slot to exhibit a transient reduced diametric condition for joinder with the display support.

In a particularly preferred embodiment, the spherical member comprises a pair of generally hemispherical elements interior flat surfaces of which are in spaced facing relation, the slot extending fully with the flat surfaces and therebeyond into the stem. The slot partially bifurcates the stem thereby defining first and second opposed stem arms, each stem arm being contiguous with a distinct one of the hemispherical elements.

In the combination provided by the invention, the display support has a hollow interior and an opening extending longitudinally with the support and communicating with the interior and the hanger transient reduced diameter is of dimension equal to or less than the width of the display support opening, whereby the spherical member may be inserted in and retained releasably by the display support.

Other objects and features of the invention will be further understood from the following detailed description of the particularly preferred embodiments thereof and from the drawings, wherein like reference numerals identify like parts and components throughout.

DETAILED DESCRIPTION OF PREFERRED EMBODIMENTS AND PRACTICES

Figure 3:
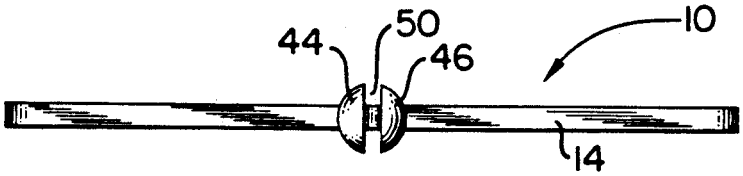
FIG. 3 is a top plan view of the FIG. 1 hanger.
Figure 1:
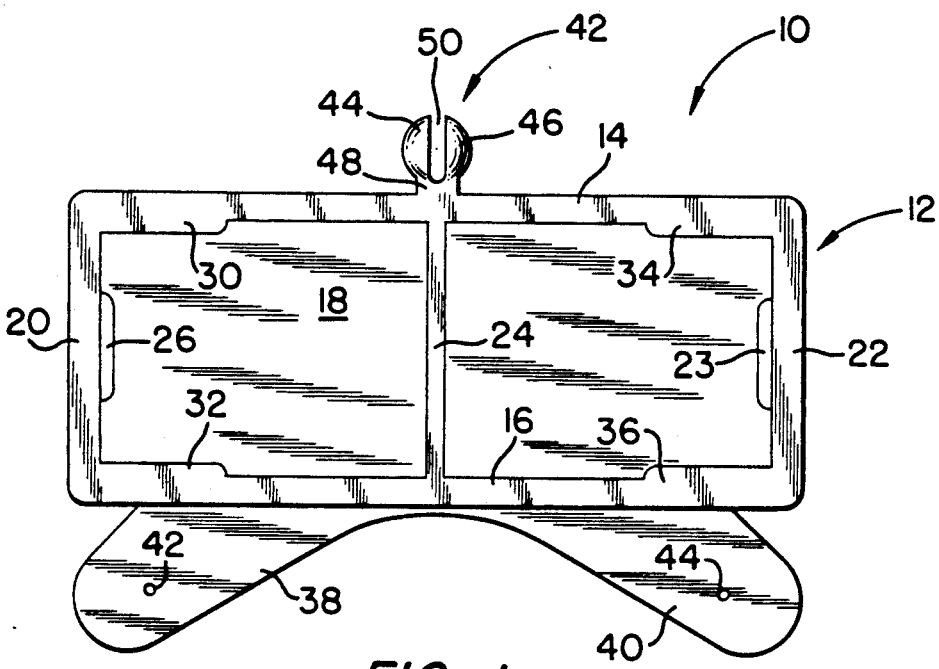
FIG. 1 is a front elevation of a hanger in accordance with the invention.
Figure 2:
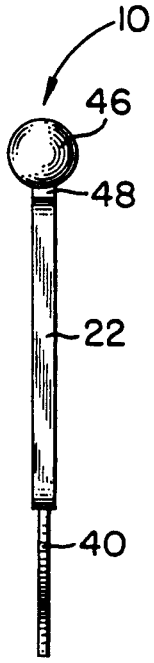
FIG. 2 is a right side elevation of the FIG. 1 hanger.
Figure 4:
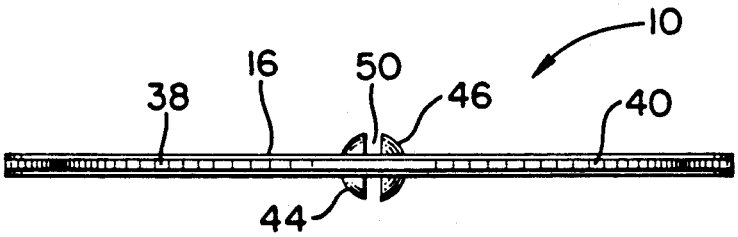
FIG. 4 is a bottom plan view of the FIG. 1 hanger.

Referring to FIGS. 1–4, hanger 10 is comprised of an integral body of resilient material having a first portion 12 adapted for releasable receipt of a garment and for providing manufacturer's logo indication and garment size identification. First portion 12 is a planar, open frame having a top marginal piece 14, a bottom marginal piece 16 bounding central opening 18 with side marginal pieces 20 and 22. Central strut 2 braces the first portion against deformation on garment hanging. Logo member constraints in the form of ears 26 and 28 are provided on the rearward side of first portion 12 and ears 30, 32, 34 and 36 on the front side of first portion 12.

First hanger portion 12 has a depending pair of lobes 38 and 40 having respective openings 42 and 44. Conventional plastic strip locking members may be applied to lobes 38 and 40 to pass through openings 42 and 44 and then be secured to lock garments to the lobes. Applicants contemplate present usage of hanger 10 for the hanging of slippers.

Turning now to the second portion 42 of hanger 10, for suspending the hanger from a display rod, it includes a stem projecting from the first portion and a centrally slotted generally spherical member supported by the stem and closable on such slot to exhibit a transient reduced diametric condition for joinder with the display rod.

Figure 5:
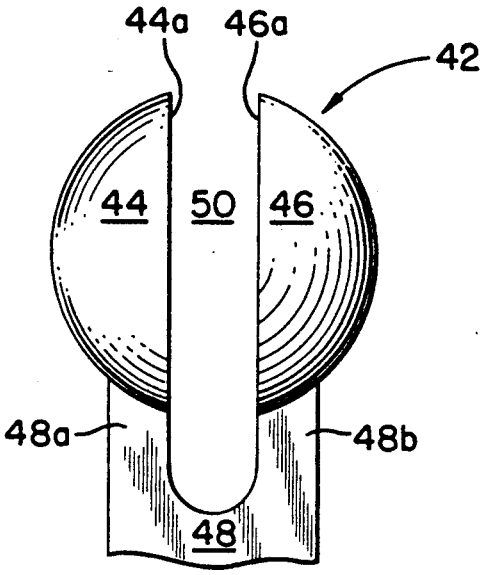
FIG. 5 is an enlarged partial showing of the stem and generally spherical member of the FIG. 1 hanger.

In its particularly preferred configuration, seen especially in the enlarged view of FIG. 5, the spherical member comprises a pair of generally hemispherical elements 44 and 46 interior flat surfaces **44*a* and 46*a* of which are in spaced facing relation. Elements 44 and 46 are supported by stem 48, specifically by arms 48*a* and 48*b*. Slot 50 extends fully with the flat surfaces and therebeyond into the stem, bifurcating the stem to form such arms 48*a* and 48*b*, each stem arm being contiguous with a distinct one of the hemispherical elements 44 and 46**.

Figure 6:
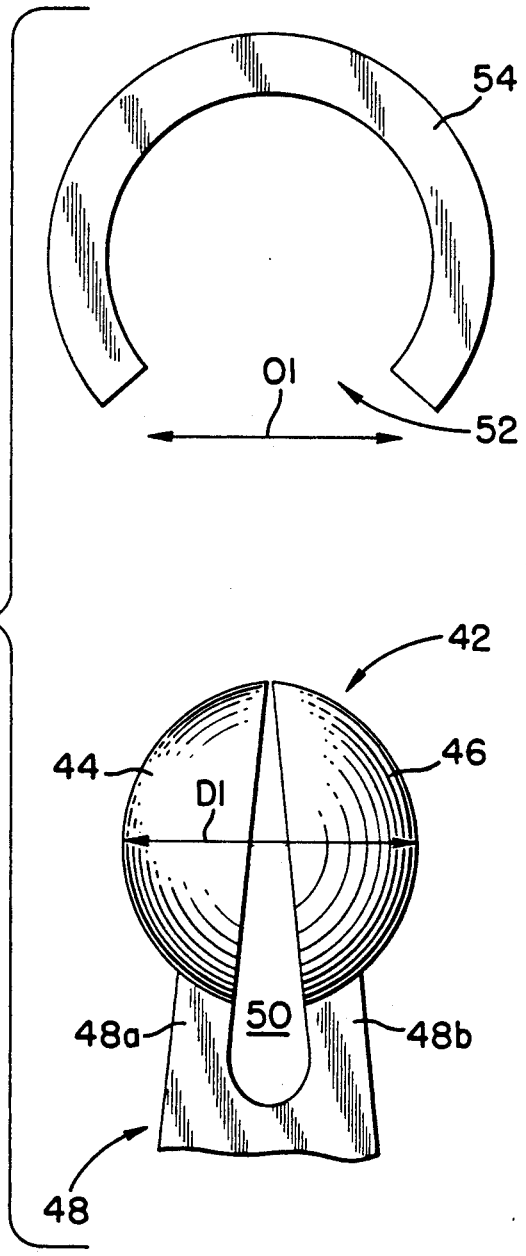
FIG. 6 in part repeats the showing of FIG. 5, with the spherical member manipulated to exhibit its reduced transient diameter, and in other part shows and end view of a display rod for receiving the spherical member in such reduced diameter condition thereof.
Figure 7:
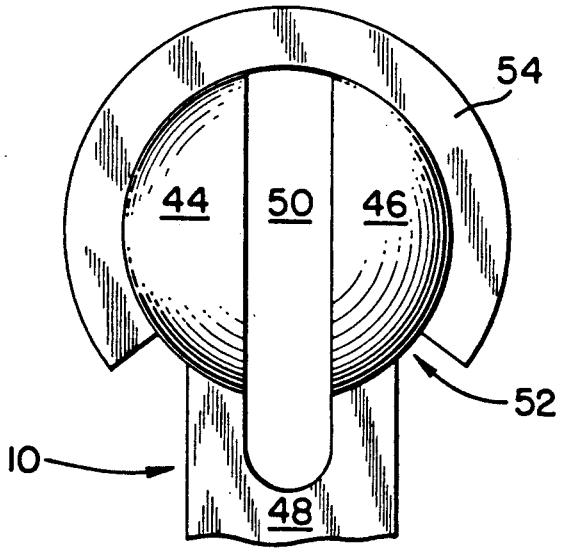
FIG. 7 is an end view of the FIG. 6 assembly of the spherical member with the display rod.

Turning to FIG. 6, second hanger portion 42 is shown manipulated to be of reduced diameter, this being achieved by a user applying finger pressure to stem arms **48*a* and 48*b* to cause hemispherical elements 44 and 46 to engage one another at the upper extremes thereof. The reduced diametric dimension of second hanger portion 42 is D1, which corresponds with the dimension O1 of opening 52 of display rod 54. Accordingly, hanger portion 42 may be inserted within display rod 54, through opening 52 in such manipulated condition thereof. Following such insertion, the assembly of FIG. 7 results, based on relaxation of the deformed spherical member to its FIG. 5 state. In the FIG. 7 assembly such relaxation is effective to releasably retain hanger 10 with display rod 54**.

Figure 8:
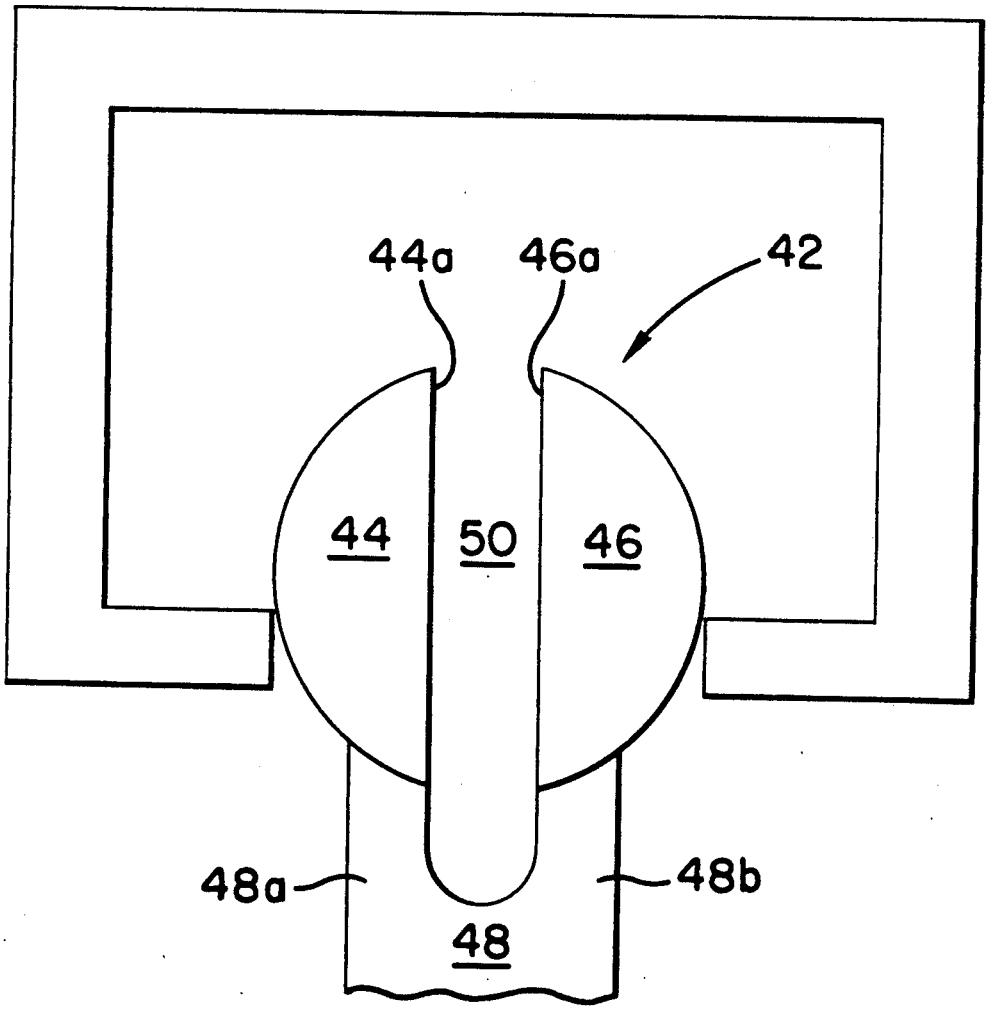
FIG. 8 illustrates the spherical member in assembly with a further display support in the form of a hollow cube with an opening in its undersurface for receiving the spherical member.

Turning to FIG. 8, it illustrates a display support 56, in the form of a hollow cube or tube, having opening 58 in its undersurface extending into the hollow interior of the support. Opening 58 is sized as in the case of the display rod opening 52 for releasable retention of hanger second portion 42. While display rod 54 exhibits a generally circular interior hollow, display cube exhibits a generally rectangular interior hollow.

Whereas the foregoing has looked to insertion of the hanger of the invention in a display rod by insertion of the hanger radially into a display rod or sidewardly into a display tube, through an opening corresponding in dimension to a reduced transitory dimension attainable by manipulation of the hanger second portion, the invention contemplates other joinder of the hanger and display rod. Thus, the hanger second portion 42 may be manipulated to such reduced transitory dimension thereof and then inserted into the display support longitudinally thereof. In this instance, the display support opening need only be of dimension to permit the passage of the stem 48 therein.

Various changes in structure and modifications in practice may be introduced without departing from the invention. Thus, it is to be understood that the foregoing particularly depicted and described preferred embodiments and practices are intented in an illustrative and not in a limiting sense. The true spirit and scope of the invention is set forth in the following claims.

I claim:

1. A garment hanger comprised of an integral body of resilient material having a first portion adapted for releasable receipt of a garment and a second portion for suspending said hanger from a display support, said second portion including a stem projecting from said first portion and a centrally slotted generally spherical member supported by said stem and closable on such slot to exhibit a transient reduced diametric condition for joinder with said display support.

2. The invention claimed in claim 1 wherein said spherical member comprises a pair of generally hemispherical elements interior flat surfaces of which are in spaced facing relation, said slot extending fully with said flat surfaces and therebeyond into said stem.

3. The invention claimed in claim 2 wherein said slot partially bifurcates said stem thereby defining first and second opposed stem arms, each said stem arm being contiguous with a distinct one of said hemispherical elements.

4. The invention claimed in claim 1 wherein said hanger first portion includes an open frame defining a window for receipt of an insert bearing indication of characteristics of said garment, said stem being contiguous with said frame, said frame defining means for releasable retention of said insert therein.

5. The invention claimed in claim 4 wherein said spherical member comprises a pair of generally hemispherical elements interior flat surfaces of which are in spaced facing relation, said slot extending fully with said flat surfaces and therebeyond into said stem.

6. The invention claimed in claim 5 wherein said slot partially bifurcates said stem thereby defining first and second opposed stem arms, each said stem arm being contiguous with a distinct one of said hemispherical elements.

7. The invention claimed in claim 1 wherein said display support is a display rod having a generally circular hollow interior.

8. The invention claimed in claim 1 wherein said display support is in the form of a cube having a generally rectangular hollow interior.

9. In combination, (a) a display support having a hollow interior and an opening extending longitudinally with said support and communicating with said interior; and (b) a garment hanger comprised of an integral body of resilient material having a first portion adapted for releasable receipt of a garment and a second portion for suspending said hanger from said display support, said second portion including a stem projecting from said first portion and a centrally slotted generally spherical member supported by said stem and closable on such slot to exhibit a transient reduced diameter of dimension less than the width of said display support opening.

10. The invention claimed in claim 9 wherein said spherical member comprises a pair of generally hemispherical elements interior flat surfaces of which are in spaced facing relation, said slot extending fully with said flat surfaces and therebeyond into said stem.

11. The invention claimed in claim 10 wherein said slot partially bifurcates said stem thereby defining first and second opposed stem arms, each said stem arm being contiguous with a distinct one of said hemispherical elements.

12. The invention claimed in claim 9 wherein said hanger first portion includes an open frame defining a window for receipt of an insert bearing indication of characteristics of said garment, said stem being contiguous with said frame, said frame defining means for releasable retention of said insert therein.

13. The invention claimed in claim 9 wherein said display support is a display rod having a generally circular hollow interior.

14. The invention claimed in claim 9 wherein said display support is in the form of a cube having a generally rectangular hollow interior.

15. In combination, (a) a display support having a hollow interior and an opening extending longitudinally with said support and communicating with said interior; and (b) a garment hanger comprised of an integral body of resilient material having a first portion adapted for releasable receipt of a garment and a second portion for suspending said hanger from said display support, said second portion including a stem projecting from said first portion and a slotted member supported by said stem and closable on such slot to exhibit a transient reduced diameter of dimension less than the width of said display support opening.

16. The invention claimed in claim 15 wherein said slotted member comprises a pair of elements interior surfaces of which are in spaced facing relation, said slot extending fully with said flat surfaces and therebeyond into said stem.

17. The invention claimed in claim 16 wherein said slot partially bifurcates said stem thereby defining first and second stem arms, each said stem arm being contiguous with a distinct one of said elements.

18. The invention claimed in claim 15 wherein said hanger first portion includes an open frame defining a window for receipt of an insert bearing indication of characteristics of said stem being contiguous with said frame, said frame defining means for releasable retention of said insert therein.

19. The invention claimed in claim 15 wherein said display support is a display rod having a generally circular hollow interior.

20. The invention claimed in claim 15 wherein said display support is in the form of a cube having a generally rectangular hollow interior.

* * * * *